United States Patent [19]

Bussan et al.

[11] Patent Number: 5,044,704

[45] Date of Patent: Sep. 3, 1991

[54] ADJUSTABLE REFRIGERATOR CRISPER DRAWER STRUCTURE

[75] Inventors: Marc R. Bussan; Ronald K. Hupfer; Marion J. Weis, all of Evansville, Ind.

[73] Assignee: Whirlpool Corporation, Benton Harbor, Mich.

[21] Appl. No.: 525,881

[22] Filed: May 17, 1990

[51] Int. Cl.[5] ..... A47B 81/00

[52] U.S. Cl. ..... 312/214

[58] Field of Search ..... 312/214, 342, 345, 270

[56] References Cited

U.S. PATENT DOCUMENTS

| | | | |
|---|---|---|---|
| Re. 21,178 | 8/1939 | Forsthoefel . | |
| 2,072,446 | 3/1937 | Forsthoefel . | |
| 2,241,053 | 5/1941 | Brightman . | |
| 2,421,089 | 5/1947 | Smith | 312/345 |
| 2,484,997 | 10/1949 | Heidenblut . | |
| 2,665,817 | 1/1954 | Whitmore . | |
| 3,063,772 | 11/1962 | Kennedy . | |
| 3,220,789 | 11/1965 | Kronenberger . | |
| 3,266,858 | 8/1966 | Klotz . | |
| 3,565,504 | 2/1971 | Brown . | |
| 4,173,378 | 11/1979 | Hanson et al. . | |
| 4,241,668 | 12/1980 | Carroll . | |
| 4,597,616 | 7/1986 | Trubiano | 312/345 |
| 4,729,613 | 3/1988 | Tromble et al. . | |

*Primary Examiner*—Joseph Falk

*Attorney, Agent, or Firm*—Jeffers, Hoffman & Niewyk

[57] ABSTRACT

An adjustable refrigerator crisper drawer structure including a frame having three discrete locations for removable drawer support members. Thus the drawer support members may be located at discrete locations to accommodate various drawer sizes. One end of the drawer support member is locked to the support frame. The other end is slideably received in the support frame. Two rigid rails are provided for reinforcing the support frame. The rails are secured to the front and rear members of the frame and respectively support the front and rear portions of the drawer support member.

19 Claims, 5 Drawing Sheets

ADJUSTABLE REFRIGERATOR CRISPER DRAWER STRUCTURE

BACKGROUND OF THE INVENTION

This invention relates to household refrigerators and in particular to the crisper drawer structure for a household refrigerator.

Conventional refrigerators commonly include a freezer compartment, a fresh food compartment and an access door for each of these compartments. The fresh food compartment conventionally includes one or more crisper drawers located in the bottom of the fresh food compartment. The drawers are conventionally slideably carried on supports so as to permit the drawers to be drawn forwardly out of the fresh food compartment when the access door of the fresh food compartment is opened, thereby providing user access to vegetables and other foods stored in the crisper drawers In order to maintain the crispness of stored food, the top of the drawers is closed when the drawers are in their storage position within the fresh food compartment. In view of the desire by consumers to store many types of fresh food in such crisper drawers, it is desirable to provide multiple drawers in a side by side arrangement. Such drawer structures have been provided in the prior art. In such prior art structures, a nonadjustable drawer arrangement has been provided so that the drawers could not be adjusted to suit the desire or needs of particular consumers. However, it is desirable to offer the consumer various side by side drawer arrangements such as for instance a single wide drawer, a narrow drawer and a medium width drawer, or three narrow drawers so that the consumer can choose the drawer arrangement to suit his needs.

It is therefore desired to provide an adjustable drawer arrangement for a refrigerator wherein various arrangements of drawers may be provided by means of a common support structure. It is furthermore desired to provide a flexible drawer arrangement and a support structure which is rugged and will support heavily loaded drawers.

In many prior art refrigerator structures, the access door to the fresh food compartment includes shelves on its inner surface for storage of articles to be refrigerated. In many refrigerator installations, the door of a refrigerator may not be opened more than 90°, thereby causing interference with the drawers if the drawers are to be withdrawn completely from the fresh food compartment. It is therefore desired to provide an adjustable refrigerator drawer structure wherein the drawers may be removed from the fresh food compartment without interference with the door even though the door cannot be opened more than 90°. Furthermore, it is desired to provide an adjustable refrigerator drawer structure wherein the entire drawer structure may be removed for cleaning.

SUMMARY OF THE INVENTION

The present invention provides an adjustable crisper drawer structure for a refrigerator including a frame for supporting the drawers. The frame includes front and rear members and two side members. The front and rear members also include slots for receiving respective ends of drawer support members. The front end of the drawer support member is slideably received in the slot in the front frame member. The rear end of the drawer support member is interlocked with the rear frame member. The drawer support members include channels for slideably receiving the drawers. Additionally, two support rails are secured respectively to the front and rear members for supporting the respective front and rear ends of the drawer support members.

If it is desired to completely remove the drawers from the refrigerator, the drawer support members can be loosened by unlocking the rear ends thereof from the rear frame member, so that the entire drawer support members can be removed and the drawers can be completely removed from the refrigerator.

An advantage of the present invention is that an adjustable drawer structure is provided whereby the consumer may be provided with a choice of drawer arrangements. Another advantage of the present invention is that the drawer support structure is very sturdy and can support heavily loaded drawers. An additional advantage of the present invention is that the drawers may be easily removed from the refrigerator, even though the door of the refrigerator cannot be swung open more than 90°.

A still further advantage of the present invention is that the structure is very simple and economical of construction while yet providing an adjustable drawer arrangement as discussed above.

The present invention, in one form thereof, comprises a food storage drawer assembly for a refrigerator including a frame adapted to be horizontally secured within the refrigerator. The frame includes front and rear frame members and two side members. A plurality of drawer support members having horizontal channels therein are secured to the frame. A plurality of support member receiving means are provided in each the respective front and rear members for receiving respective ends of the drawer support members. Front and rear support rails are respectively secured to the front and rear frame members. A plurality of drawers are slideably received in the prospective horizontal channels of the drawer support members.

The present invention, in one form thereof, comprises a food storage drawer assembly for a refrigerator and includes a frame adapted to be horizontally secured within the refrigerator. The frame includes front and rear members and two side support members. A plurality of drawer support members are provided for defining horizontal channels. The drawer support members each include a locking end and a sliding end. A plurality of first apertures are provided in the front frame member and a plurality of second apertures are provided in the rear frame member for respectively receiving the sliding and locking ends of each drawer support member. The front and rear support rails are respectively secured to the front and rear frame members. A plurality of drawers are slideably received in the respective horizontal channels of the drawer support members.

The present invention, in one form thereof, comprises a food storage drawer assembly for a refrigerator. A plastic frame is horizontally secured within the refrigerator. The frame includes front and rear frame members and two side members. A plurality of drawer support members are provided with horizontal channels therein. Each drawer support member includes a locking end and a sliding end. A plurality of first apertures are provided in the front frame member and a plurality of second apertures are provided in the rear frame member for respectively slideably receiving the sliding end and lockingly receiving said locking end of each drawer support member. Front and rear support rails are respectively secured to the front and rear frame members for respectively supporting sliding and locking ends. A plurality of drawers are slideably received in the respective horizontal channels.

It is an object of the present invention to provide an adjustable crisper drawer structure for a refrigerator which is very sturdy so that it can provide adequate support for heavily loaded crisper drawers. It is a further object of the present invention to provide an adjustable crisper drawer structure which enables the user to remove the crisper drawers even though the refrigerator door cannot be fully opened. A still further object of the invention is to provide a crisper drawer structure which is adjustable so that various drawer arrangements can be accommodated. Lastly, it is an object of the present invention to provide an adjustable crisper drawer structure which is simple in construction and which is economical to manufacture.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
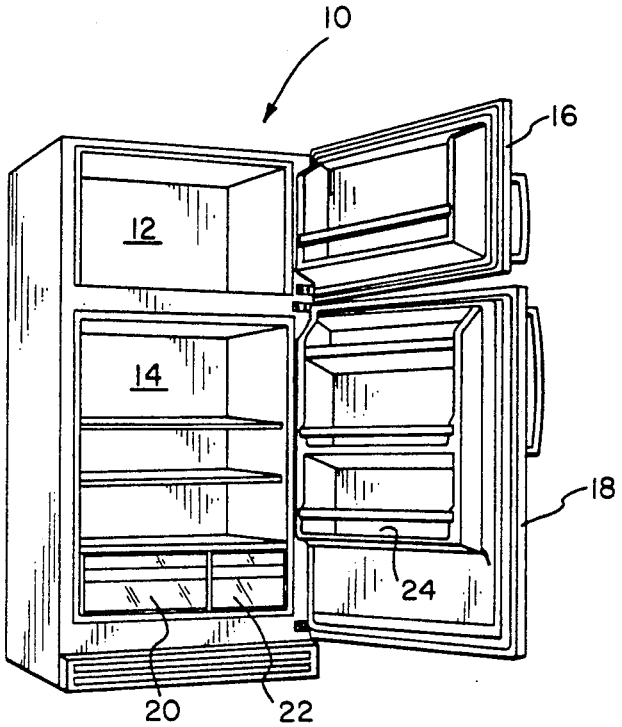
FIG. 1 is a perspective view of a refrigerator having an adjustable crisper drawer structure according to the present invention.

Corresponding reference characters indicate corresponding parts throughout the several views of the drawings. The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Referring to FIG. 1 wherein is shown a conventional refrigerator 10 having a freezer compartment 12 and a fresh food compartment 14. An access door 16 is provided for the freezer compartment 12 and an access door 18 is provided for the fresh food compartment 14. Two crisper drawers 20 and 22 are shown mounted side by side in the lower portion of fresh food compartment 14. Door 18 is provided with shelves 24 as is conventional for supporting in the door various items to be refrigerated.

Figure 2:
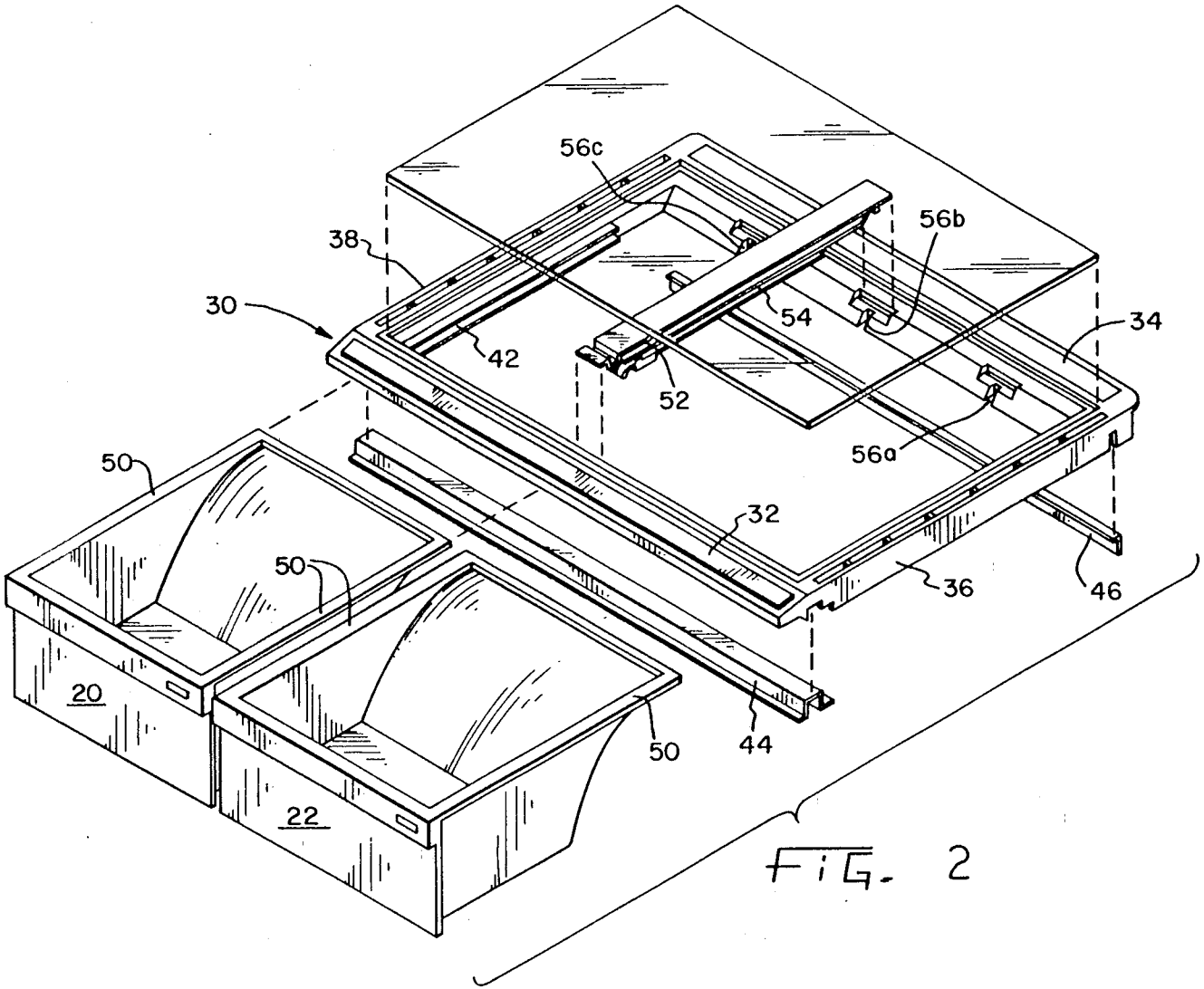
FIG. 2 is an exploded perspective view of the adjustable crisper drawer structure according to the present invention.

Referring now to FIG. 2 the drawer structure according to the present invention is shown including a drawer support frame 30. Frame 30 includes a front member 32, a rear member 34, and side members 36 and 38. Frame 30 is mounted in fresh food compartment 14 by having side members 36 and 38 supported b suitable means on the inside walls of fresh food compartment 14. Frame 30 is provided with a cover 40 which is conventionally made of glass so that the contents of drawers 20, 22 can be inspected. Side members 36 and 38 are each provided with a track 42 wherein drawer flanges 50 are respectively supported to slideably support the sides of drawers 20 and 22. The entire frame 30 may be molded as a unitary plastic molding. A front rail 44 is shown to provide rigid support for the front of drawers 20 and 22. Similarly, a rear rail 46 is provided to rigidly support the rear of drawers 20 and 22. Rails 44 and 46 are constructed of rigid and strong material such as for instance steel or aluminum. A drawer support member 52 is provided for supporting the adjoining flanges 50 of drawers 20 and 22. As can be seen in FIG. 2, drawer support member 52 includes a track 54 on the right hand side thereof. A similar track is provided, as further disclosed hereinafter, on the left hand side of drawer support member 52. Front frame member 32 and rear frame member 34 include apertures for the mounting of drawer support members 52. In FIG. 2 the apertures 56 can be seen in rear member 34 and it is noted that three such apertures 56 are provided. Thus, in this embodiment as many as three drawer support members 52 may be inserted in frame 30. In the embodiment shown in FIG. 2 only a single such center mounted drawer support member 52 is shown so that, in this embodiment, two equal sized drawers are supported. However it should be noted that if a single drawer support member 52 were inserted in either the right hand aperture **56*a* or the left hand aperture 56*c*, that a narrow drawer and a medium size drawer could be simultaneously supported. If no drawer support member 52 were provided, a single wide drawer could be accommodated by frame 30**.

Figure 3:
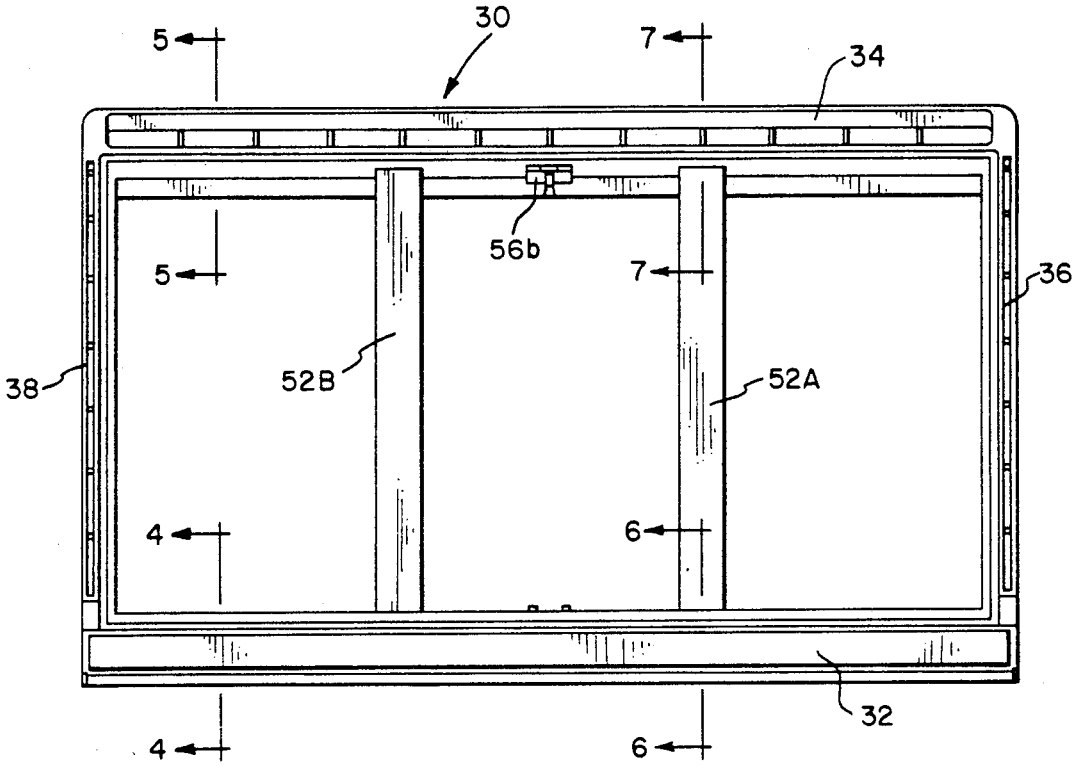
FIG. 3 is a top plan view of the crisper drawer structure of FIG. 2.
Figure 8:
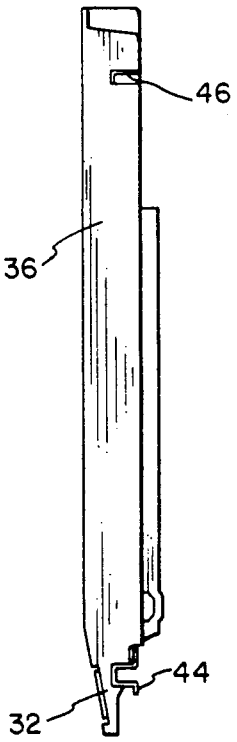
FIG. 8 is a side elevational view of the drawer support frame.
Figure 13:
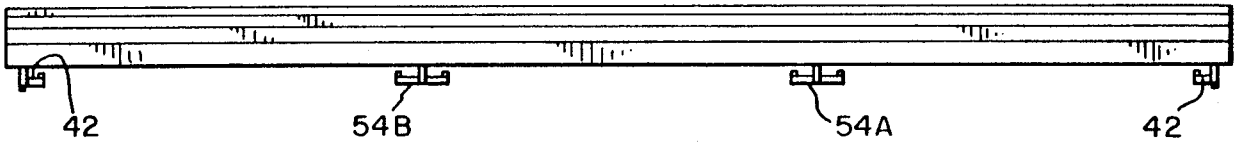
FIG. 13 is a front elevational view of the drawer support frame assembly.

Referring to FIG. 3, it can be seen that two drawer support members **52*a* and 52*b* are provided so that in this embodiment three drawers of equal sizes may be accommodated by the frame structure. FIG. 13 shows a front view of the frame assembly of FIG. 3 including tracks 42 on the sidewalls 36 and 38 and tracks 54*a* and 54*b* for drawer support members 52*a* and 52*b***.

Figure 12:
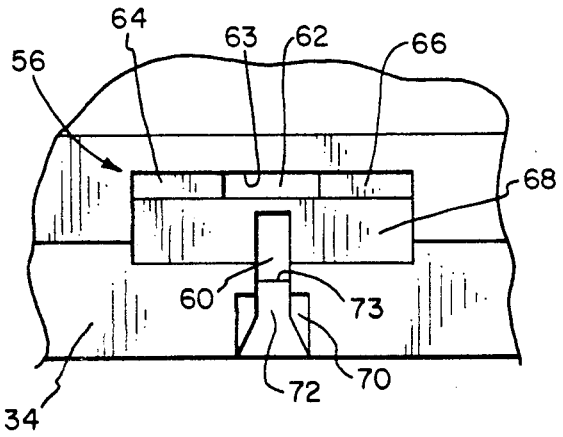
FIG. 12 is a partial enlarged plan view of a drawer support member aperture in the rear frame member.
Figure 6:
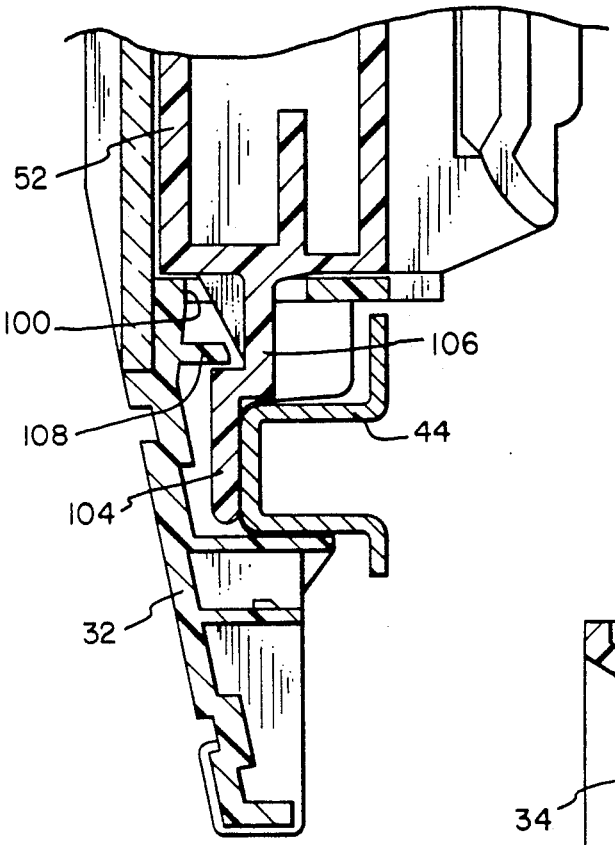
FIG. 6 is a partial cross sectional view of the assembled drawer support member and the front frame member taken along line 6—6 of FIG. 3.
Figure 10:
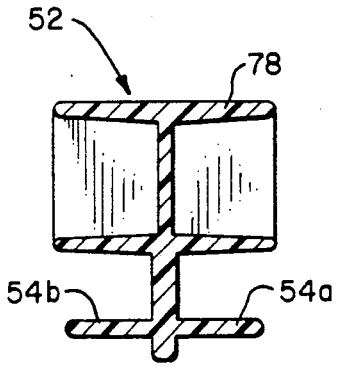
FIG. 10 a cross sectional view of the drawer support member of FIG. 9 taken along line 10—10 thereof.
Figure 9:
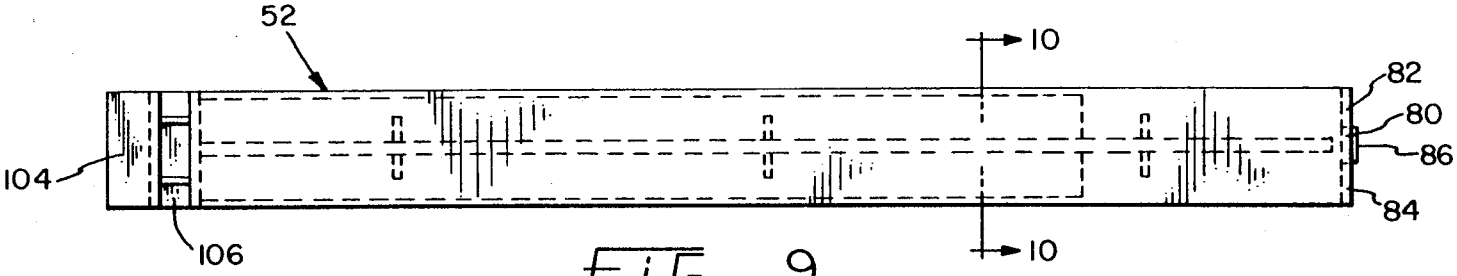
FIG. 9 is a top plan view of a drawer support member.
Figure 11:
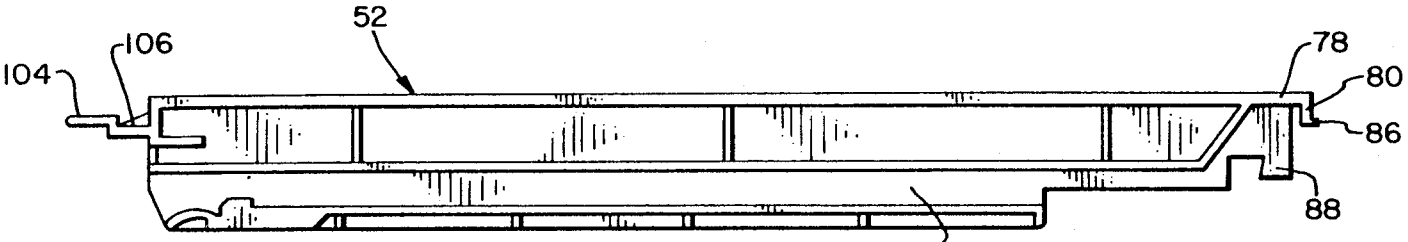
FIG. 11 is a side elevational view of the drawer support member of FIG. 9.

Referring now to FIGS. 5, 7, 9, 11, and 12 the locking structure for locking the rear portion of a drawer support member 52 into rear member 34 is shown. In FIG. 12 an aperture 56 is shown in detail. The aperture includes a through slot 60, and three side by side slots 62, 64, and 66. Slot 62 is deeper than adjacent slots 64 and 66. Slot 62 also defines a wall 63. Through slot 60 defines a wall 73. Recess 68 accommodates wall 78 of drawer support member 52. A chamfered lead-in 70 has been provided for recess 60. At the lower end of lead-in 70 a surface 72 is provided. Drawer support member 52, as best seen in FIGS. 9 and 11, includes three lips at its rear portion, namely lips 80, 82, and 84. Lip 80 is somewhat longer than lips 82 and 84 so that lip 80 may be accommodated in slot 62. Lips 82 and 84 are respectively received in slots 64 and 66 of rear member 34. Lip 80 also includes a protrusion 86 which cooperates with wall 63 for locking the rear portion of the drawer support member in place.

Figure 5:
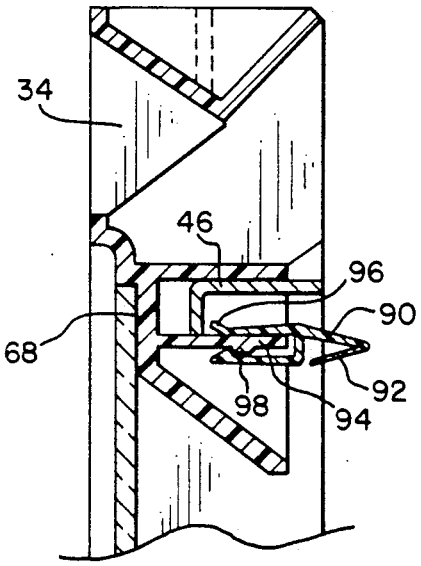
FIG. 5 is a partial cross sectional view of the rear frame member line 5—5 of FIG. 3.

Referring now to FIG. 5, it can be seen that a seal 90 has been secured on a wall portion 94 of rear member 34. The seal includes a lip seal portion 92 which cooperates with a drawer when the drawer is fully inserted into the support assembly. Seal 90 is snapped in place over protrusions 98 on wall 94 so that seal 90 also provides the function of retaining rear rail 46 in place by means of protruding portion 96. Seal 90, upon its insertion onto wall member 94, will be snapped and retained in place to prevent removal of rear rail 46.

Figure 7:
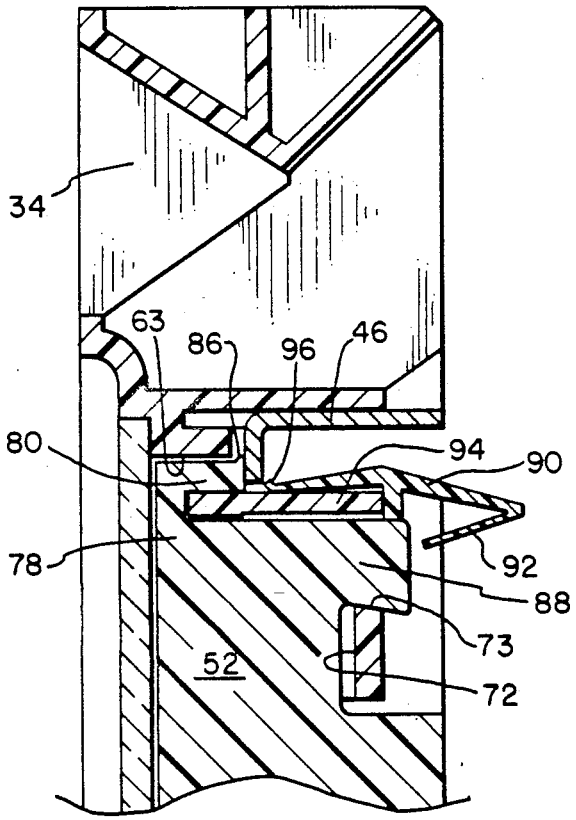
FIG. 7 is a partial enlarged cross sectional view of the drawer support member and the rear frame member taken along line 7—7 of FIG. 3.

Referring now to FIG. 7, the assembly of the drawer support member into aperture 56 of rear member 34 is shown. Lip 80 can be seen to be received in slot 62. Protrusion 86 will have cleared wall 63. Locking finger 88 of drawer support member 52 has been received in slot 60 and is in engagement with wall 73. Because of the angled construction of locking finger 88, the rear portion of drawer support member 52 is locked in place. If it is attempted to pull up on the rear portion of drawer support member 52, protrusion 86 must clear wall 63 to permit locking finger 88 to clear side wall 73. Thus, a snap fit is accomplished for locking the rear portion of drawer support member 52 in place.

An important feature of the invention is that finger 80 of drawer support member 52 rests on rear rail 46 and is supported thereby. Thus, the weight of the drawers supported on drawer support member 52 will in large part be borne by rear rail 46. Thus, the structure provides a very sturdy and rigid supporting assembly for heavily loaded drawers.

Figure 4:
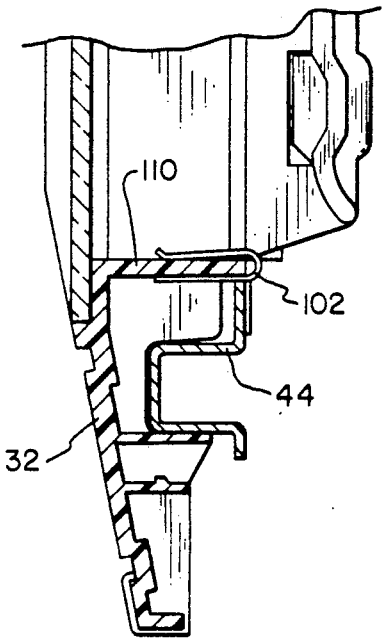
FIG. 4 is a partial cross sectional view of the front frame member taken along line 4—4 of FIG. 3.

FIGS. 4, 6, 9 and 11 show the assembly of the front portion of the drawer support member to the front frame member. Front frame member 32 includes a slot generally indicated at 100 into which stepped flange 104 of drawer support member 52 is inserted. The stepped flange 104 also includes a portion 106. The stepped portion accommodates projection 108 of front frame member 32, thereby preventing the drawer support member from forward movement once inserted into slot 100. Front rail 44 is retained on front frame member 32 by means of a plurality of metal spring clips 102, one of which is shown in FIG. 4 and which is retained on an inside wall 110 of front frame member 32. It can be seen that the front portion of drawer support member 52 is supported on rail 44 by means of flange 104. Thus the front portion of the drawer support structure is firmly supported by rail 44. The entire drawer support structure is rigid and strong so that the crisper drawers will be supported, regardless of loading, by the structure. Furthermore, by the easy assembly and disassembly of the structure, various drawer sizes may be accommodated by the crisper drawer structure, thereby enabling various drawer arrangements to be used.

If it is desired to completely remove the drawers from the fresh food compartment of the refrigerator, while the refrigerator door is opened no more than 90°, the following procedure can be followed. First the glass cover is removed from the frame. The drawer located opposite the hinge of the door is removed. The remaining drawers are then pulled forward as far as possible. The drawer support member which supports the remaining drawers is unlocked at its rear end and the rear portion of the drawer support member is raised by sliding it toward the rear of the fresh food compartment. The entire drawer support member is now removed. The pan can then be slid sideways in the fresh food compartment and may be pulled forward to be removed from the refrigerator.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a refrigerator having a cabinet defining a fresh food compartment with a front access opening, a door for selectively closing said opening, a food storage drawer assembly comprising:

a frame horizontally disposed within said compartment, said frame including front and rear frame members and two side frame members;

a plurality of drawer support members having horizontal channels therein;

a plurality of drawer support member receiving means in each said respective front and rear members for receiving respective ends of each said drawer support members;

front and rear support rails respectively secured to said front and rear frame members and detachably connected to said cabinet; and a plurality of drawers slideably received in respective said horizontal channels.

2. The assembly according to claim 1 wherein said respective ends of said drawer support members are removably received in said drawer support member receiving means.

3. In a refrigerator having a cabinet defining a fresh food compartment with a front access opening, a door for selectively closing said opening, a food storage drawer assembly comprising:

a frame horizontally disposed within said compartment, said frame including front and rear frame members and two side frame members;

a plurality of drawer support members having horizontal channels therein;

a plurality of drawer support member receiving means in each said respective front and rear members for receiving respective ends of each said drawer support member, at least one of said drawer support member receiving means includes locking means for locking a received end of a said drawer support member in a said drawer support member receiving means;

front and rear support rails respectively secured to said front and rear frame members and detachably connected to said cabinet; and a plurality of drawers slideably received in respective said horizontal channels.

4. The assembly according to claim 3 wherein the respective ends of said drawer support members are supported on said respective front and rear support rails.

5. The assembly according to claim 3 including a cover received on said frame for covering said frame and said drawers.

6. The assembly according to claim 3 wherein said front and rear support rails are made of metal and wherein said frame is made of plastic.

7. In a refrigerator having a cabinet defining a fresh food compartment with a front access opening, a door for selectively closing said access opening, a food storage drawer assembly comprising:

a frame horizontally disposed within said compartment, said frame including front and rear frame members and two side frame members;

a plurality of elongated drawer support members having horizontal channels therein, said drawer support members each including a locking end having a downwardly extending lip supported by said rear frame member and a sliding end having an axially extending flange supported by said front frame member;

a plurality of first apertures in said front frame member and a plurality of second apertures in said rear frame member for respectively receiving said sliding and locking ends of each said drawer support members;

front and rear support rails respectively secured to said front and rear frame members and detachably connected to said cabinet; and a plurality of drawers slideably received in respective said horizontal channels.

8. The assembly according to claim 7 wherein said respective locking and sliding ends of said drawer support members are removably received in said first and second apertures.

9. The assembly according to claim 7 wherein at least one of said support member receiving means includes locking means for locking said locking end of a said support member in a said second aperture.

10. The assembly according to claim 7 wherein the locking and sliding ends of said drawer support members are respectively supported on said rear and front support rails.

11. The assembly according to claim 7 including a cover received on said frame for covering said frame and said drawers.

12. The assembly according to claim 7 wherein said front and rear support rails are made of metal and wherein said frame is made of plastic.

13. The assembly according to claim 7 including sealing means for a said drawer secured to said rear frame member for securing said rear support rail to said rear frame member.

14. In a refrigerator having a cabinet defining a fresh food compartment with a front access opening, a door for selectively closing said opening, a food storage drawer assembly comprising:

a plastic frame horizontally disposed within said compartment, said frame including front and rear members and two side members;

a plurality of drawer support members having horizontal channels therein, said drawer support members each including a locking end having a downwardly extending lip supported by said rear frame member and a sliding end having an axially extending flange supported by said front frame member;

a plurality of first apertures in said front member and a plurality of second apertures in said rear member for respectively slideably receiving said sliding end and lockingly receiving said locking end of each said drawer support members;

front and rear support rails respectively secured to said front and rear frame members for respectively supporting said sliding and locking ends, said front and rear support rails detachably connected to said cabinet; and a plurality of drawers slideably received in respective said horizontal channels.

15. The assembly according to claim 14 wherein said respective locking and sliding ends of said drawer support members are respectively removably received in said second and first apertures.

16. The assembly according to claim 14 wherein at least one of said second plurality of apertures includes locking means for locking a said locking end of one said support members in place.

17. The assembly according to claim 14 including a cover received on said frame for covering said frame and said drawers.

18. The assembly according to claim 14 wherein said front and rear support rails are made of metal.

19. The assembly according to claim 14 including sealing means for a said drawer secured to said rear frame member for securing said rear support rail to said rear frame member.

* * * * *